United States Patent [19]

Saueressig

[11] Patent Number: 4,864,926

[45] Date of Patent: Sep. 12, 1989

[54] INTAGLIO PRINTING CYLINDER HAVING A CORE AND A SLEEVE RELEASABLY FASTENED THERETO

[75] Inventor: Karl W. Saueressig, Vreden, Fed. Rep. of Germany

[73] Assignee: Saueressig & Co., Vreden, Fed. Rep. of Germany

[21] Appl. No.: 206,216

[22] Filed: Jun. 13, 1988

[30] Foreign Application Priority Data

Jun. 19, 1987 [EP] European Pat. Off. ..... 87108763.1

[51] Int. Cl.[4] ..... B41F 9/06; B41F 9/00

[52] U.S. Cl. ..... 101/153; 101/378

[58] Field of Search ..... 101/153, 378, 382, 382.1, 101/383

[56] References Cited

U.S. PATENT DOCUMENTS 4,656,942 4/1987 Vertegaal et al. ..... 101/375 X

FOREIGN PATENT DOCUMENTS 0196443 10/1986 European Pat. Off. ..... 101/153

2742002 3/1979 Fed. Rep. of Germany ..... 101/153

*Primary Examiner*—Edgar S. Burr

*Assistant Examiner*—James Lisehora

*Attorney, Agent, or Firm*—Felfe & Lynch

[57] ABSTRACT

Intaglio printing cylinder, comprising a core of a virtually undeformable material and a multilayer sleeve joined releasably thereto. The new intaglio printing cylinder especially is more durable than prior cylinders of a similar type, and it is interchangeable with conventional solid metal intaglio printing cylinders. The new intaglio printing cylinder is characterized by the fact that on the outside of the first, inner layer of the sleeve a plurality of ribs projecting outwardly and running substantially in the longitudinal direction of the cylinder are disposed. This intaglio printing cylinder has an improved stability, especially against circumferential shifting or displacement within the sleeve and thus is more durable. An additional improvement of its working characteristics is achieved by a continuous electrical continuity from the core to the outer copper layer. The new intaglio printing cylinder is especially suitable as a substitute for the solid metal printing cylinders still in use. It offers the advantage that, with a single core, a plurality of sleeves of different outside diameters can be used.

12 Claims, 3 Drawing Sheets

INTAGLIO PRINTING CYLINDER HAVING A CORE AND A SLEEVE RELEASABLY FASTENED THERETO

The invention relates to an intaglio printing cylinder, comprising a core of a virtually undeformable material and a sleeve releasably fastened thereto, the latter being drawn onto the core and removed therefrom with the aid of a compressed air cushion, the core having at least one passage for delivering compressed air to its circumferential surface, the sleeve being composed of at least four concentric layers of different materials of which the inner layer comprises a relatively thin, inherently stable material of low resiliency, the second, next layer outward comprising more resilient and slightly compressible material, the third layer comprising a stiff and inherently stable material, and the fourth, outer layer comprising a copper coating bearing the gravure, and the cylinder being able to have different outside diameters while the inside diameter of the sleeve remains the same by means of different thicknesses of the second and/or third layer of the sleeve.

An intaglio printing cylinder of the above kind is described in an earlier proposal of the applicant, namely EP-A No. 87 101 690.3. This intaglio printing cylinder has found acceptance on account of its ease of handling and the printing quality it can achieve, but it has been found that, with regard to its functional properties, especially for long-term use under heavy stresses and for ease of use and preparation in interchange with conventional intaglio cylinders, it is in need of improvement. It has been found to be a disadvantage that, when the cylinder is subjected to severe and constant use, circumferential shifting and turning of the individual layers of the sleeve relative to one another can occur which adversely affects stability and dimensional accuracy, especially the true rotary running of the sleeve. Another disadvantage is to be seen in the fact that formerly, in the case of intaglio printing cylinders with removable sleeve, special devices are necessary for producing an electrically conductive connection between core and copper coating for the purpose of galvanic copper plating, and these interfere with free interchangeability with conventional, all-metal intaglio printing cylinders.

The problem is to improve the intaglio printing cylinder of the kind described above with regard to its functional properties. In particular, the new intaglio printing cylinder is to have an improved load-bearing ability and durability. Also, the new intaglio printing cylinder must be usable and workable easily in interchange with conventional intaglio printing cylinders.

The solution of this problem is achieved according to the invention by a intaglio printing cylinder of the kind described above, which is characterized in that on the outside of the first inner layer of the sleeve a plurality of outwardly projecting ribs are disposed, which run substantially longitudinally of the cylinder.

The ribs on the outside of the first layer of the sleeve provide such that relative shifting or turning between the individual layers of the sleeve or within one layer of the sleeve can virtually no longer occur, since the ribs offer a very great mechanical resistance to such shifting.

For the shaping of the ribs, provision is preferably made such that they have each two curving flanks enclosing an acute angle and merging radially on the inside with the outer surface of the first layer. This results on the one hand in a high stability and shear resistance of the ribs and on the other hand in a secure transfer of force to the layer next following.

A further improvement of the flow of power between the first and the second layer of the sleeve can be achieved by inclining or tilting the ribs in the direction of rotation of the cylinder.

In a preferred embodiment of the cylinder, provision is made for the ribs to be disposed in a plurality of groups of two, each being a pair of closely adjacent ribs. This arrangement of the ribs has an especially high mechanical stability and advantageously can be made in a simple manner by pressing a rod of round material for each pair of ribs into the still-uncured material of the first layer, which is preferably made of glass fiber reinforced plastic and, after the hardening of the plastic, is removed again. The number of ribs or pairs of ribs amounts preferably to four to ten, evenly distributed over the circumference.

Another step in the direction of improved durability of the intaglio printing cylinder is to make the second layer of the sleeve from a continuous strand of rubber or polyurethane material in the form of a spiral whose turns are spaced slightly apart and wound with an elastic bias on the outside of the first layer of the sleeve. As a result of the elastic bias of the strand the ribs are pressed tightly against the inside of the strand, thereby achieving great security against circumferential slippage. Preferably the height of the ribs and the thickness of the strand are selected such that the ribs penetrate all the way to the outside surface of the strand forming the second layer of the sleeve. The ribs thus also further contribute to security against slippage between the second and third layer of the sleeve.

A bias stretching the strand of the second layer of the sleeve to about twice its length in the unstretched state has proven to be especially favorable to the intaglio printing cylinder. A bias of this order of magnitude provides on the one hand for a tight seating of the second layer of the sleeve on the first layer and at the same time assures that the elasticity and compressibility of the second layer of the sleeve will still be sufficient to enable the sleeve to be drawn onto and off from the core.

In order on the one hand to improve the adhesion between the second, spiral layer of the sleeve and its third layer, and on the other hand to prevent penetration of material of the third layer, preferably glass fiber-reinforced plastic, into the circumferential vacant space of the second layer, provision is made for applying a covering that will close off from the outside at least the circumferential gap present between the turns of the strand, preferably an adhesive strip. The adhesive strip can be provided either on the inside only or on both sides with a coating of adhesive. Also, its surface can be provided with a friction-increasing texture.

For the mechanical stabilization of the sleeve ends and for the purpose of carrying current to the outside copper layer, the intaglio printing cylinder preferably has at each end of the sleeve a metal ring whose inside diameter is slightly greater than the inside diameter of the first, inner layer of the sleeve, and whose outside diameter is equal to the outside diameter of the third layer of the sleeve, the rings being mounted on the ends of the copper layer. The two metal rings consist preferably of brass, copper, lead or lead alloy, and are of an L-shaped cross section, the outside of the one leg of the L lying against the inside of the copper layer and the outside of the other leg of the L forming part of the end face of the sleeve. In this manner a large electric current transfer surface is made available, and a large conductive cross section.

In order to dispense with any contact elements at the end faces of the sleeve for the purpose of electroplating additional copper onto the copper layer, the intaglio printing cylinder has preferably a longitudinally slotted sheet metal cylinder, preferably of copper, embedded into the face-end areas of the inside of the first layer, the inside diameter of which corresponds to that of the inner layer and which is conductively connected to the adjacent metal ring. In this manner, when a sleeve is drawn onto a core, an electrically conducting connection of the core of the printing cylinder to the outer copper layer is formed without the need for any external aids such as contact plates or the like. When the copper layer is electroplated with additional copper the new intaglio printing cylinder can thus easily be treated in the same manner as a conventional solid-metal intaglio printing cylinder.

In order to prevent not only relative rotations within the sleeve of the intaglio printing cylinder but also between the core and the sleeve, the intaglio printing cylinder can have a locking means acting circumferentially at least at one end of the core and the sleeve and formed of at least one groove and a spine. A preferred embodiment of the locking means is for the lock to comprise a pair of toothed rings at each face end of the cylinder, one ring joined to the core and having external teeth and the other joined to the sleeve and having internal teeth fitting into the external teeth, the inside diameter of the toothed ring of the sleeve that leads when the sleeve is drawn onto the core being slightly larger than the inside diameter of the sleeve, and the outside diameter of the toothed ring at the opposite end of the core being slightly smaller than the outside diameter of the core. Due to the above-mentioned sizing of the rings it is brought about that they do not in any way interfere with drawing the sleeve onto the core or from the core. On account of the meshing of the teeth, which is accomplished almost automatically when the sleeve is drawn onto the core, just before it reaches the end, a reliable transfer of power between the core and sleeve is achieved, so that they are unable to rotate against one another. The toothed rings present on the sleeve can be made integral with the metal rings at the ends of the sleeve in order to simplify the manufacture of the cylinder.

The intaglio printing cylinder according to the present invention can have either a cylindrical core or a tapered core, the latter being known, and being preferred on account of the easier installation and removal of the sleeve. Depending on the construction of the core, only the metal rings and toothed rings have to be matched in their diameters. The transition from the taper of the inside of the sleeve to the fully cylindrical circumferential surface of the sleeve is situated preferably within the third layer of the sleeve whose thickness is variable within wide limits.

In accordance with the invention, an intaglio printing cylinder comprises a core of a virtually undeformable material and a sleeve releasably joined to the latter. The sleeve is drawable onto and from the core by means of a compressed air cushion. The core has at least one passage for carrying compressed air to its circumferential surface. The sleeve comprises at least four concentric layers of different materials of which the inner layer comprises a relatively thin, inherently stable, slightly resilient material. The second, outwardly next layer comprises a more resilient and slightly compressible material. The third layer comprises a stiff and inherently stable material. The fourth outer layer comprises a copper layer bearing the gravure. The cylinder is able to have a different outside diameter for the same inside diameter of the sleeve through different thicknesses of the second or third layer of the sleeve. On the outside of the first, inner layer of the sleeve a plurality of ribs project outwardly and run substantially longitudinally of the cylinder.

Preferred embodiments of the invention will be further described below with the aid of a drawing, wherein.

Figure 1:
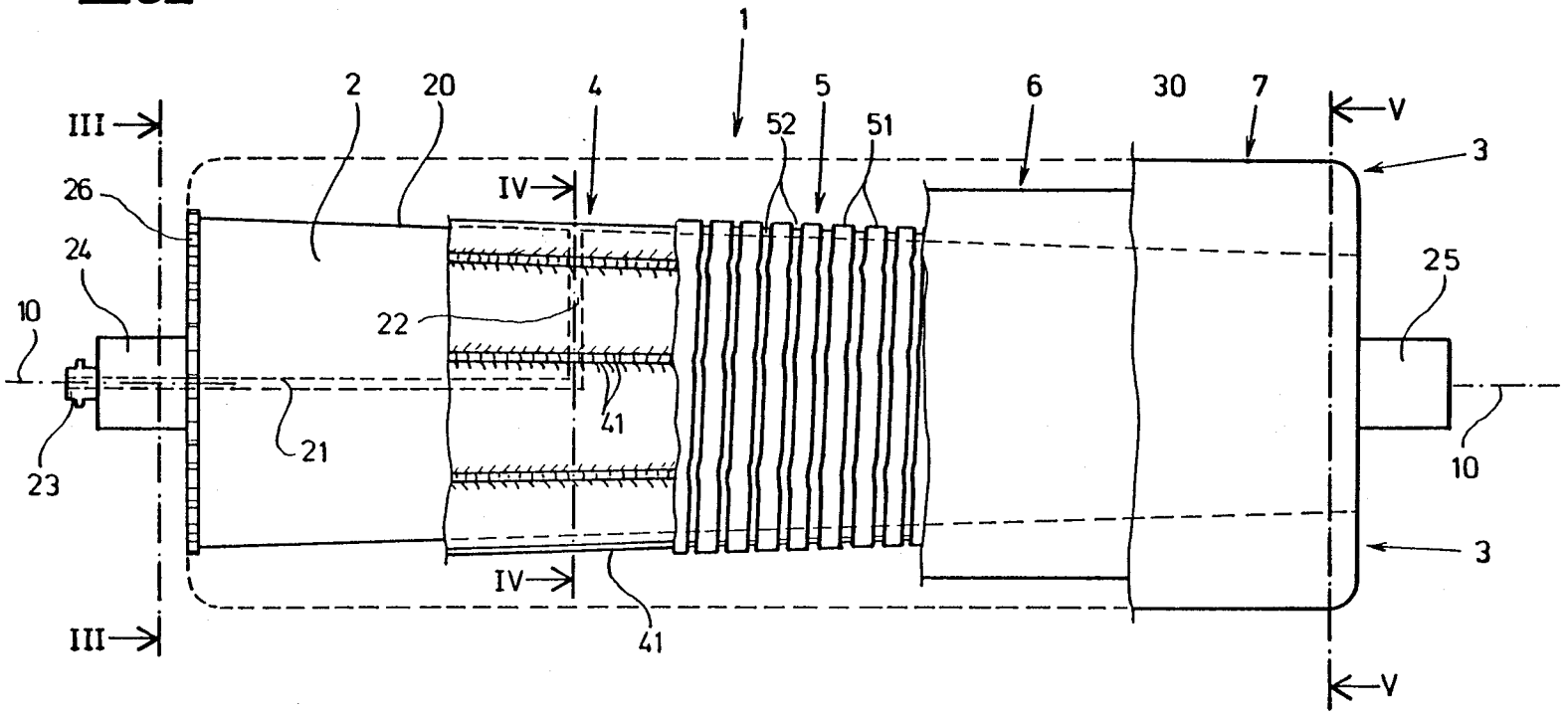
FIG. 1 is a side view of the intaglio printing cylinder, partially cut away.
Figure 2:
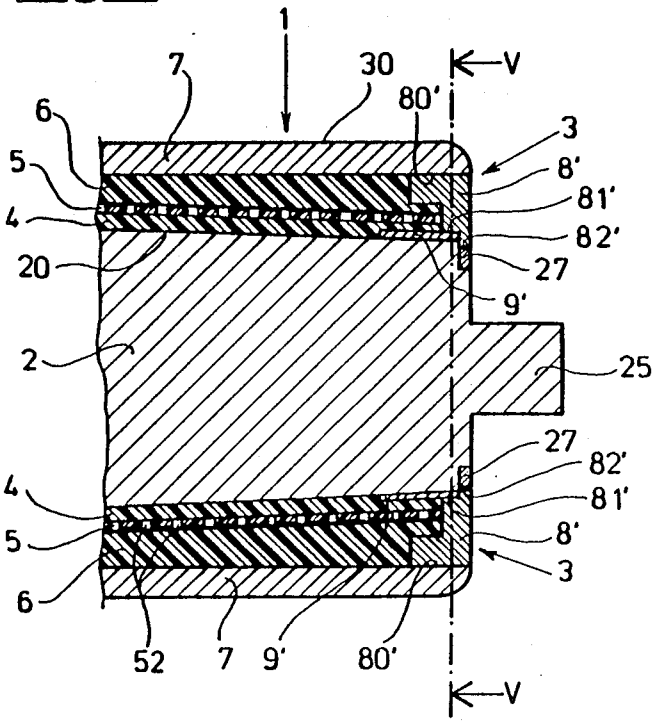
FIG. 2 is a longitudinal cross section through the central axis of the right end of the intaglio printing cylinder of FIG. 1.
Figure 5:
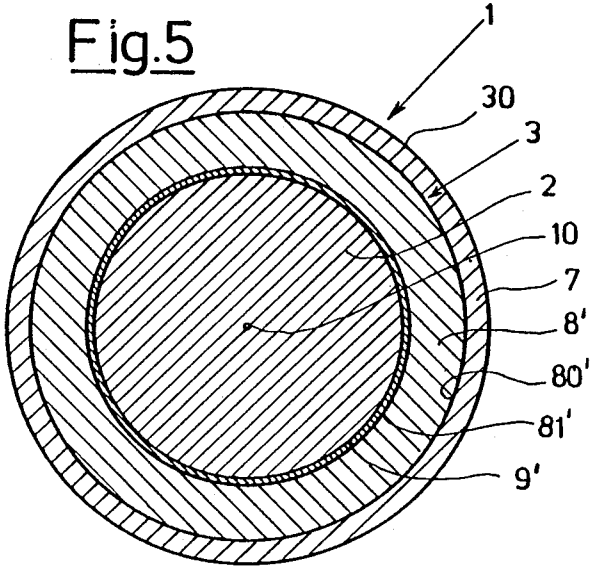
Figure 4B:
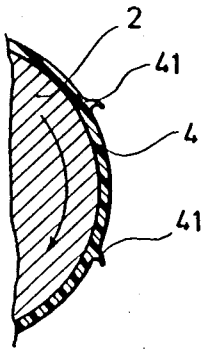
Figure 4A:
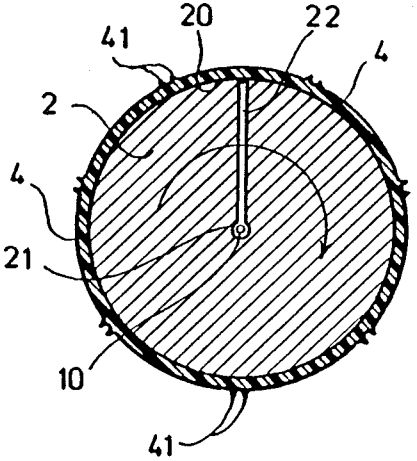

FIG. 4*a* shows the intaglio printing cylinder in a partial cross section along line IV—IV in FIG. 1;

FIG. 4*b* shows the intaglio printing cylinder in a partial cross section corresponding to FIG. 4*a*, in a modified embodiment; and FIG. 5 shows the intaglio printing cylinder in a cross section along line V—V in FIG. 1 and FIG. 2.

As FIG. 1 of the drawing shows, the represented embodiment of the intaglio printing cylinder 1 comprises a core 2 with a circumferential surface and a sleeve 3 drawn onto the latter and having a matingly formed inner surface and a cylindrical circumferential surface 30. In this FIG. as well as in FIG. 2 the tapered shape of the core 2 is exaggerated to render it more easily seen; in practice it amounts to only about 0.1 to 0.2 mm per meter of core length.

At the end faces of the core 2 are disposed stub shafts 24 and 25, respectively, for mounting the printing cylinder 1. On the left stub shaft 24 there is also a compressed air fitting 23 from which an air passage 21 enters into the core 2 parallel to the central axis 10 of the core. The length of the air passage 21 preferably amounts to about one-third to about one-half of the length of the core 2. From the end of the longitudinally running air passage 21 runs a radial air passage 22 which terminates openly at the circumferential surface 20 of the core 2. The passages 21 and 22 serve to carry compressed air from the connection 23 between the circumferential surface 20 of the core 2 and the inside of a drawn-on sleeve 3. In this manner an air cushion is formed between the core 2 and the sleeve 3, as is known in itself, whereby a slight expansion of the sleeve 3 is produced which permits the sleeve 3 to be drawn on and off.

In the left part of FIG. 1 the viewer sees the circumferential surface 20 of the core 2. To the right of that can be seen the first layer 4 of the sleeve 3. This preferably comprises glass-fiber-reinforced plastic and has, for example, a thickness of about 1 mm. On the outside of the first layer 4 are disposed several outwardly projecting ribs 41 running lengthwise of the intaglio printing cylinder 1 and arranged in pairs, which are made integral with the material of layer 4.

In the section following on the right of the intaglio printing cylinder shown in FIG. 1 can be seen the second layer 5 of the sleeve 3. This preferably comprises a continuous strand of material 51, preferably rubber or polyurethane, wound in a coil on the second layer 4 of the sleeve 3. Between the individual turns of the material strand 51 remains a circumferential gap 52 which permits a certain radial compression of the strand 51. As it can furthermore be seen, the strand 51 is wound on the layer 4 with such a tension that the ribs 41 present on the latter press all the way to the outside of the strand 51 of the second layer 5 of the sleeve 3.

The next area of the intaglio printing cylinder on the right is formed by the third layer 6 of the sleeve 3, which here consists of a glass fiber-reinforced plastic and has a relatively great thickness. Moreover, in the embodiment represented it provides for a transition from the taper of the first layers 4 and 5 of the sleeve 3 to a cylindrical external form. It is to be noted at this point that the great taper represented in FIG. 1 is greatly exaggerated for visualization. In practice a taper of about 0.1 to 0.2 mm per meter of core length is sufficient.

In the last, i.e., outer right portion of FIG. 1 can be seen the outer layer 7 of the sleeve 3 which consists of a copper layer. Its exterior forms the circumferential surface 30 of the intaglio printing cylinder 1 and serves to receive the intaglio gravure. The application of the copper layer 7 to the preceding layer 6 of the sleeve is preferably performed by first applying a copper prime coating by the flame spraying method and then performing an additional electroplating of copper.

At the outer left end of the core 2 there can finally be seen in FIG. 1 a toothed ring 26 which forms part of an interlocking means between sleeve 3 and core 2. The manner of operation of this interlock will be more precisely described later on.

FIG. 2 shows the right end portion of the intaglio printing cylinder 1 from FIG. 1 in a longitudinal section. The inner portion of the cylinder 1 is again formed by the core 2 with its stub shaft 25 at the end. In contact with its tapering circumferential surface 20 is the likewise tapering interior of the first layer 4 of the sleeve 3. This is adjoined on the outside by the second layer 5 of the sleeve which preferably comprises the continuous strand of an elastic material. Between the individual turns of the strand of layer 5 can be seen the cicumferential gap 52 which permits a lateral expansion of the material strand upon the radial compression of the layer 5. In this manner a slight expansion of the interior of the sleeve is possible, i.e., of the inner layer 4, with resilient deformation of the layer 5, without affecting the outlying layers 6 and 7 of the sleeve 3. In FIG. 2 it can also be seen that the third layer 6 of the sleeve 3 has a relatively great thickness and forms the transition between the taper of the sleeve interior and the cylindrical shape of the sleeve exterior. The copper coating 7, which forms the outer layer of the sleeve 3, has a constant thickness throughout. At the end of the cylinder 2 the copper coating is rounded off, resulting in a cylindrical circumferential surface 30 which corresponds to that of conventional intaglio printing cylinders.

At its end the sleeve 3 has two more additional components. The first of these two parts is a metal ring 8' of L-shaped cross section. The outside 80' of the one leg of the L runs lengthwise of the cylinder 1 and lies flush against the inside of the copper coating 7. The outside of the second leg of the L of the metal ring 8' lies in the end face of the sleeve 3 and covers the ends of the three inner layers 4, 5 and 6 of the sleeve 3.

The second additional element is a circumferential sheet metal hoop 9' lying flush against the core 2 on the inside of the inner layer 4 of the sleeve 3, and its inside diameter corresponds to the inside diameter of the sleeve 3 and of the inner layer 4 of the sleeve 3. The sheet metal hoop 9' is slotted at, at least one and preferably at, several points on the length of the cylinder so as to permit the hoop to accompany any expansion of the inner layer 4 of the sleeve 3.

The metal ring 8' is in electrically conductive association through a portion of the inner end of the end leg of the L with the outside of the sheet metal hoop 9'. Thus, as it can be seen best in FIG. 2, an electrically conductive connection is established from the metal core 2 through the sheet metal hoop 9' and the metal ring 8' to the copper layer 7.

Furthermore, in FIG. 2, a toothed ring 27 is also to be seen at the right end of the core 2; its teeth are external and it is inserted into the end face of the core 2. The previously mentioned metal ring 8' has at its end portion of the inner leg of the L that is not in contact with the sheet metal hoop 9' the internal teeth 82' made for meshing with the external teeth in the toothed ring 27. This makes it possible for the toothed ring 27 and the teeth 82' of the metal ring 8' to mesh when the sleeve 3 is pushed onto the core 2. In this manner an effective interlock is established circumferentially of the intaglio printing cylinder between core 2 and sleeve 3.

Figure 3:
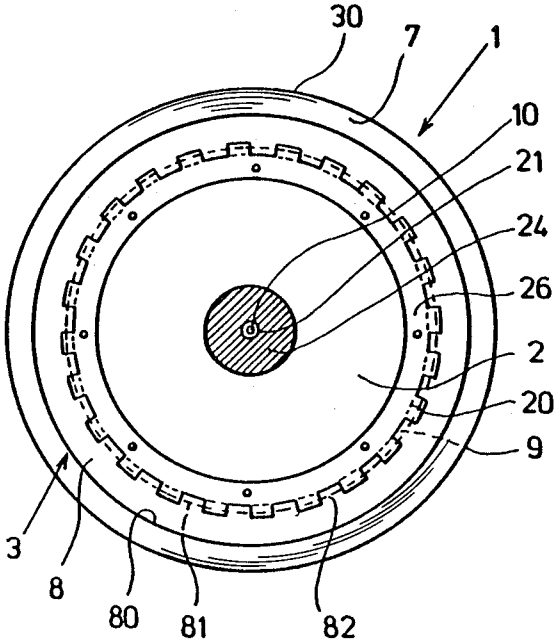
FIG. 3 is an end-on view of the left end of the intaglio printing cylinder, partially in section along line III—III of FIG. 1.

FIG. 3 is an end elevation of the left end of the intaglio printing cylinder from FIG. 1, the stub shaft at that end being shown in cross section. The center point of FIG. 3 forms the axis of rotation 10 of the intaglio printing cylinder 1. Around the latter can be seen the section surface of the stub shaft 24 of the core 2 through which the air supply passage 21 runs centrally. Around the stub shaft 24 can be seen a portion of the end surface of the core 2 into which the toothed ring 26 is placed with its teeth pointing radially outward. As already explained in connection with FIG. 1, the toothed ring 26 is toothed externally. Outwardly the toothed ring 26 is followed by the sleeve 3 of which only the metal ring and the outer copper coating 7 can be seen in this end view. The metal ring 8 is shaped like the above-described metal ring 8' at the other end of the sleeve 3 and differs from the latter only in its inside diameter. The same applies to the toothed rings 26 and 27 at the end faces of the core 2, which are of similar configuration and differ only in their outside diameter.

The metal ring 8 has an internal tooting 82 which is configured to fit into the teeth of the toothed ring 26 and meshes precisely with the latter.

Behind or under the teeth of the toothed ring 26 runs the terminal edge of the circumferential surface 20 of the core 2; since it is not visible it is represented in broken lines. At a slight radial distance outward the inner surface 81 of the metal ring 8, also represented in phantom, runs parallel thereto, which is also represented in broken lines. Between the two lies the sheet metal hoop 9 which with the exception of its diameter is made in the same manner as the previously described sheet metal hoop 9' in FIG. 2.

Considering FIGS. 1, 2 and 3 together it becomes apparent that the two toothed rings 26 and 27 of the core 2 of the intaglio printing cylinder 1 differ in their diameters. At the same time the difference in diameter is determined not only by the taper of the core but is even greater. Thus, the outside diameter of the right toothed ring 27 at the smaller-diameter end of the core 2 is slightly smaller than the outside diameter of core 2 in this area. The toothed ring 26 at the other end of the core 2, however, has an outside diameter that is greater than the outside diameter of core 2 at this point, so that the teeth project radially beyond the circumferential surface 20 of the core 2. The inside diameter of the teeth 82 and 82' of metal rings 8 and 8', respectively, of the sleeve 3 are dimensioned accordingly, i.e., the inside diameter of the left metal ring 8 of the sleeve 3 is slightly larger than the inside diameter of the sleeve 3 and of the inner layer 4 of sleeve 3 at this point, and the inside diameter of the right metal ring 8' of sleeve 3 is greater than the inside diameter of sleeve 3 and the inner layer 4 of sleeve 3 in this area. This brings it about that, when the sleeve 3 is drawn onto the core 2, or when the sleeve 3 is withdrawn from the core 2, the teeth 82 of the left metal ring 8 of the sleeve 3 as well as the toothed ring 27 at the right end of core 2 cannot come in contact with the circumferential surface 20 of the core 2 or the inside of the inner layer 4 of the sleeve 3. Thus a secure interlocking of core 2 and sleeve 3 in the circumferential direction is created, which in no way interferes with the drawing on and off of the sleeve 3 and which requires no movable apparatus parts.

FIG. 4*a* shows a section through the intaglio printing cylinder 1 along line IV—IV in FIG. 1, the section being taken through the core 2 and the first layer 4 of the sleeve 3. In the center of FIG. 4*a* can again be seen the axis of rotation 10 of the intaglio printing cylinder. Parallel to the latter runs the air passage 21 of which the end inside the core can be seen in FIG. 4*a*. From the end of this passage 21 the passage 22 runs, as a continuation of the latter, outwardly to the circumferential surface 20 of the core 2. The possibility is thus provided for pumping compressed air to produce an air cushion between the circumferential surface 20 of the core 2 and the inside of the sleeve 3 and the inside of the inner layer 4 of the sleeve 3.

The inner layer 4 of the sleeve 3 has as mentioned, ribs 41 projecting outwardly on its outside, lengthwise of the cylinder. In the cross-sectional representation in FIG. 4*a* can be seen the shape of the ribs 41. They are uniformly distributed in pairs over the circumference of the layer 4 and have curved flanks which enclose an acute angle radially on the outside and which merge smoothly radially inward with the outside surface of the inner layer 4.

A second example of the configuration of the projecting ribs 41 on the inside layer 4 of the sleeve 3 is shown in FIG. 4*b*. In this partial cross section can be seen first a portion of the core 2. On its outside the inner layer 4 of the sleeve 3 is again disposed. From the latter the ribs 41 project outwardly and here again they are integral with the layer 4. In contrast to the example shown in FIG. 4*a*, the ribs 41 here are disposed not in pairs but singly. Moreover the ribs 41 are inclined or tilted in the direction of rotation of the core 2 or of the entire intaglio printing cylinder indicated by the arrow.

Lastly, FIG. 5 shows a section through the right end portion of the intaglio printing cylinder 1 along the line V—V in FIG. 1. In the center can again be seen the axis of rotation 10 of the cylinder 1. Around the latter lies the core 2, which externally adjoins the sheet metal hoop 9'. Continuing outward, the latter is adjoined again by the inside surface 81' of the end metal ring 8' of the sleeve 3. Its outside surface 80' lies in turn against the inside of the copper coating 7 whose outer surface forms the circumferential surface 30 of the sleeve 3. As FIG. 5 clearly shows, an electrically conductive connection thus exists from the core 2 through the sheet metal hoop 9' and the metal ring 8' to the copper coating. Is this manner the input of power for the purpose of electroplating copper onto the copper coating 7, which does not differ from the conventional intaglio printing cylinders which are of massive all-metal construction.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Intaglio printing cylinder comprising:

a core of a virtually undeformable material and a sleeve releasably joined to the latter, the sleeve being drawable onto and from the core by means of a compressed air cushion, the core having at least one passage for carrying compressed air to its circumferential surface, the sleeve comprising at least four concentric layers of different materials of which the inner layer comprises a relatively thin, inherently stable, slightly resilient material, the second, outwardly next layer comprising a more resilient and slightly compressible material, the third layer comprising a stiff and inherently stable material, and the outermost fourth layer comprising a copper layer bearing a gravure image, and said second and third layers comprising means to adjust the outside diameter of the cylinder while maintaining the same inside diameter of the sleeve by varying the thickness of the second or third layer of the sleeve, and a plurality of ribs projecting outwardly from the outside of said inner layer and running substantially longitudinally of the cylinder.

2. Intaglio printing cylinder according to claim 1, in which the ribs are made uniform in material and integral with the first layer of the sleeve.

3. Intaglio printing cylinder according to claim 1, in which the ribs have curved flanks radially enclosing an acute angle on the outside and merging radially with the outer surface of the first layer on the inside.

4. Intaglio printing cylinder according to claim 1, in which the ribs are inclined or tilted to point in the direction of rotation of the cylinder.

5. Intaglio printing cylinder according to claim 1, in which the ribs are disposed in a plurality of groups of two, each being a pair of closely adjacent ribs.

6. Intaglio printing cylinder according to claim 1, in which the second layer of the sleeve is wound onto the outside of the first layer of the sleeve from a continuous strand of rubber or polyurethane in the form of a spiral of turns slightly spaced apart under elastic bias.

7. Intaglio printing cylinder according to claim 6, in which a bias stretches the strand of the second layer of the sleeve to about twice its length in the unstretched state.

8. Intaglio printing cylinder according to claim 6, in which a covering is externally applied to the second layer of the sleeve, closing off from the outside at least the circumferential gap present between the spirals of the strand.

9. Intaglio printing cylinder according to claim 1, which includes metal rings, one at each end of the sleeve, whose inside diameter is slightly greater than the inside diameter of the first, inner layer of the sleeve and whose outside diameter is equal to the outside diameter of the third layer of the sleeve and which are mounted on the ends of the copper layer.

10. Intaglio printing cylinder according to claim 9, which includes longitudinally slotted sheet metal cylinders whose inside diameter is the same as that of the inner layer and which are connected in an electrically conductive manner to adjacent metal rings, and one of which is embedded in each end face area on the inside of the first layer.

11. Intaglio printing cylinder according to claim 1, which includes locking means acting in the circumferential direction and present at least at one end of core and sleeve and formed of at least one groove and one spine.

12. Intaglio printing cylinder according to claim 11, in which the locking means consists of two toothed rings on each end of the cylinder, one ring being joined to the core and having external teeth, and the other ring being joined to the sleeve and having internal teeth fitting into the external teeth, the inside diameter of the toothed ring on the end of the sleeve which precedes when the sleeve is drawn onto the core being slightly larger than the sleeve's inside diameter, and the outside diameter of the toothed ring disposed on the end of the core which is first covered by the sleeve being slightly smaller than the outside diameter of the core.

* * * * *